United States Patent [19]

Friedrich et al.

[11] 4,431,040

[45] Feb. 14, 1984

[54] MANUAL IMPACT-TYPE LOG SPLITTER AND METHOD FOR MAKING SAME

[76] Inventors: Kenneth L. Friedrich, 11337 52nd, Lowell; Jeffrey H. TePastte, Rte. 2, Newaygo, both of Mich.

[21] Appl. No.: 314,657

[22] Filed: Oct. 26, 1981

Related U.S. Application Data

[63] Continuation-in-part of Ser. No. 212,692, Dec. 3, 1980.

[51] Int. Cl.[3] ..... B27L 7/00

[52] U.S. Cl. ..... 144/193 C; D8/47; 125/23 R; 29/434; 144/366; 228/182

[58] Field of Search ..... D8/47; 125/23 R; 173/89, 90, 91; 254/104; 144/193 R, 193 C, 193 D, 366; 76/101 D, 101 R; 29/434; 228/182

[56] References Cited

U.S. PATENT DOCUMENTS

| | | | |
|---|---|---|---|
| D. 257,575 | 12/1980 | Ideen | 254/104 |
| 368,516 | 8/1887 | Copper et al. . | |
| 948,230 | 2/1910 | Lestage | 144/193 C |
| 2,066,427 | 1/1937 | Smith | 144/193 C |
| 2,475,041 | 7/1949 | Mattson | 144/193 C |
| 2,742,266 | 4/1956 | Voelkerding | 144/193 C |
| 3,172,439 | 3/1965 | Fischer . | |
| 3,313,356 | 4/1967 | Clevenger | 144/193 C |
| 3,519,234 | 7/1970 | Matson | 144/193 C |
| 3,779,296 | 12/1973 | Echenerria . | |
| 4,254,808 | 3/1981 | Nokes | 144/193 C |
| 4,327,787 | 5/1982 | Loretto | 144/193 D |
| 4,350,192 | 9/1982 | Dent | 144/193 C |

*Primary Examiner*—W. D. Bray

*Attorney, Agent, or Firm*—Price, Heneveld, Huizenga & Cooper

[57] ABSTRACT

A manual, impact-type log splitter comprises a tubular housing having a ram slidably mounted in the lower end thereof, with a wedge or the like for splitting wood attached to the lower end of the ram. A rod-shaped weight is closely received and anchored in the upper end of the housing, and extends outwardly therefrom a predetermined distance of sufficient length to be firmly grasped by two hands. The lower end of the weight forms an impact surface against which the upper end of the ram abuts during operation, and the upper end of the weight forms a shouldered handle. Preferably, a resiliently compressible boot or sleeve is provided over the upper end of the weight and at least a portion of the upper end of the housing to provide a handle cover for secure, comfortable grasping and more efficient operation of the log splitter.

39 Claims, 4 Drawing Figures

MANUAL IMPACT-TYPE LOG SPLITTER AND METHOD FOR MAKING SAME

CROSS-REFERENCE TO RELATED APPLICATIONS

The present application is a continuation-in-part of our copending U.S. patent application Ser. No. 212,692, filed Dec. 3, 1980, entitled *WOODWACKER WOOD SPLITTER*, which is hereby incorporated by reference.

BACKGROUND OF THE INVENTION

The present invention relates to log splitters, and in particular to a manual, impact-type of log splitter and method for making same.

Impact-type, manual log splitters, such as that disclosed in U.S. Pat. No. 4,254,808 are generally known in the art, and provide a relatively simple, safe, and easily transportable mechanism for splitting firewood, and other similar applications.

Heretofore, such manual wood splitting tools have been rather expensive to manufacture, and somewhat cumbersome and/or uncomfortable to operate. The noise and jarring impact experienced during the operation of prior devices cause increased operator fatigue, and prevent the achievement of maximum efficiency. The straight cylindrical handle designs employed by prior units is rather difficult to securely grasp, thereby reducing the effective downward impact thrust which can be applied by the operator to the tool, and also transmits undesirable vibrations directly to the user's hands, which is most uncomfortable when the tool is used in cold weather. Prior safety lock mechanisms to retain the log splitter in the retracted position for transport and storage are often tedious to manipulate and/or not very reliable.

SUMMARY OF THE INVENTION

One aspect of the present invention is a manual, impact-type log splitter, comprising a hollow housing having upper and lower ends, and a ram having an upper end with means thereon for slidably mounting the same in the interior of the housing for reciprocation, and a lower end with means connected therewith for splitting wood. A weight having a lower end with a transverse cross-sectional shape which is geometrically similar to the upper end of the housing is closely received and anchored therein. The weight has a girth sized for grasping, and an upper end which extends outwardly from the housing upper end a predetermined distance of sufficient length to be firmly grasped by two hands. Preferably, the lower end of the weight forms an impact surface against which the upper end of the ram abuts during operation, and the upper end of the weight forms a shouldered handle for secure, comfortable operation of the log splitter.

Another aspect of the present invention is to provide a resiliently compressible sleeve which is disposed over and envelopes the upper end of the weight and at least a portion of the upper end of the housing to provide thermal insulation, vibratory cushioning, and a non-slip grasping surface. The sleeve preferably extends below that portion of the housing in which the impact surface is disposed, whereby the sleeve also provides sound insulation which dampens impact noise.

Yet another aspect of the present invention is an improved means for mounting the ram in the interior of the housing for reciprocation, and includes a pair of washers positioned coaxially over the upper end of the ram and fixedly attached thereto in a longitudinally spaced-apart relationship. The washers have a plan shape which is geometrically similar to the lateral cross-sectional shape of the housing, and are closely and slidingly received in the housing. An annularly-shaped guide is attached to the lower end of the housing, and includes a central opening disposed coaxially with the longitudinal axis of the housing, which is shaped to slidingly receive the ram therethrough. The uppermost washer is preferably spaced slightly below the uppermost end of the ram, whereby even after repeated use, the uppermost washer will not abut the weight.

Yet another aspect of the present invention is a method for making manual, impact-type log splitters, comprising the steps of selecting hollow tubing having a substantially uniform transverse cross-sectional shape, and a predetermined girth size. The tubing is cut to a predetermined length to define a housing with upper and lower ends. A ram is provided, having an upper end with means thereon for slidably mounting the ram in the interior of the housing for reciprocation therein, and a lower end with means connected therewith for splitting the wood. A solid rod is selected having a substantially uniform transverse cross-sectional shape, which is geometrically similar to the transverse cross-sectional shape of the housing, and is sized for close reception in the upper end of the housing, with a girth adapted for grasping. The lower end of the weight is inserted into the upper end of the housing, and is positioned therein so that the upper end of the weight extends from the upper end of the housing a distance sufficient to securely grasp the same with two hands. The lower end of the weight is fixedly anchored in the upper end of the housing, whereby the upper end of the weight forms a handle for secure, comfortable operation of the log splitter. The tubing is preferably selected with a sufficiently large side wall thickness, so that when the weight is assembled into the housing, a shoulder is formed at the base of the handle, and a resiliently compressible sleeve is assembled over the upper end of the weight and at least a portion of the upper end of the housing.

The principal objects of the present invention are to provide a manual, impact-type of log splitter having an uncomplicated design which is adapted for efficient, inexpensive manufacture. The log splitter is very durable, and includes a shouldered handle to improve operational efficiency. A sleeve is assembled over the handle, and provides a comfortable, secure grip that reduces the transmission of vibration to the operator's hands, forms a thermally insulative barrier about the housing, and dampens impact noises. The present log splitter has a very neat appearance, and is constructed so as to reduce operator fatigue. A unique lock arrangement is provided to positively retain the log splitter in a fully retracted position for safe, convenient storage and transport.

These and other features, advantages, and objects of the present invention will be further understood and appreciated by those skilled in the art by reference to the following written specification, claims, and appended drawings.

DETAILED DESCRIPTION OF THE PREFERRED EMBODIMENTS

Figure 1:
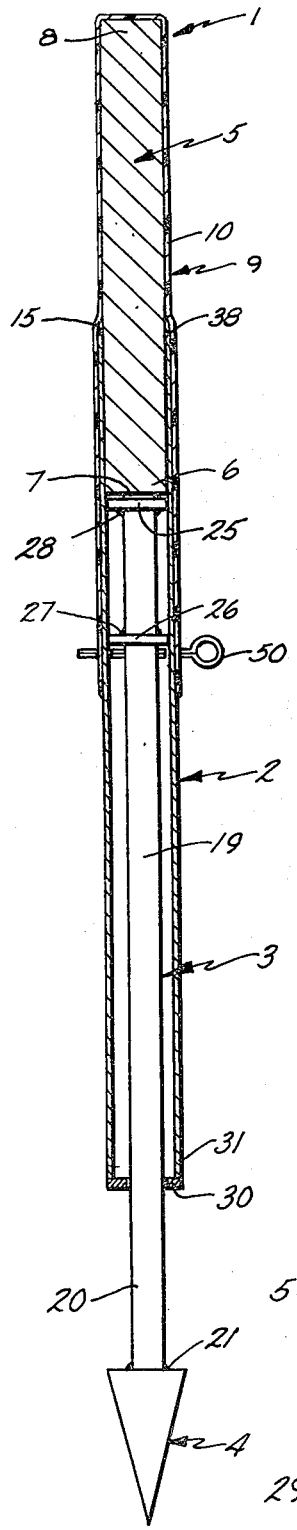
FIG. 1 is a cross-sectional view of a manual, impact-type log splitter embodying the present invention, shown in a fully retracted condition for storage and transport.

For purposes of description herein, the terms "upper", "lower", "right", "left", "rear", "front", "vertical", "horizontal", and derivatives thereof, shall relate to the invention as oriented in FIG. 1. However, it is to be understood that the invention may assume various alternative orientations, and step sequences, except where expressly specified to the contrary.

The reference numeral 1 (FIG. 1) generally designates a manual, impact-type log splitter embodying the present invention, comprising a tubular housing 2 having a ram 3 slidably mounted in the lower end thereof, with a wedge 4 or other similar device for splitting wood attached to the lower end of ram 3. A weight 5 is closely received and anchored in the upper end of housing 2, and extends outwardly therefrom a predetermined distance of sufficient length to be firmly grasped by two hands. The lower end 6 of weight 5 forms an impact surface against which the upper end 7 of ram 3 abuts during operation, and the upper end 8 of weight 5 forms a shouldered handle. A resiliently compressible boot or sleeve 10 is disposed over the upper end of weight 5, and at least a portion of the upper end of housing 2 to provide a handle cover for secure, comfortable grasping, and more efficient operation of log splitter 1.

Housing 2 is constructed of a rigid, hollow tube having a transverse cross-sectional shape which is substantially uniform along its entire length. The length of housing 2 is selected to be slightly longer than the desired stroke of ram 3. The interior dimension of housing 2 is selected so that the lower end of weight 5 is closely received therein, and the housing preferably has a side wall thickness which is sufficiently great to form a shoulder 15 between the exterior surfaces of weight 5 and housing 2 at the base of handle 9. Shoulder 15 provides a surface against which a lower one of the operator's hands may rest (FIG. 4) for more effectively imparting downward impact thrusts to the housing, thereby reducing operator fatigue. In the illustrated structure, housing 2 has a cylindrical shape, with an inside diameter in the nature of $1\frac{1}{2}$ inches, a side wall thickness in the range of 1/16 to 3/16 inches, and a length of approximately 24 inches. However, it is to be understood that housing 2 may have alternate transverse cross-sectional shapes, such as square, ovate, or the like, and may also have different dimensions, as is readily apparent to one having ordinary skill in the art. The illustrated housing 2 is constructed of a segment of mild steel pipe.

Ram 3 is slidingly mounted in the interior of housing 2 for relative, reciprocal motion. The illustrated ram 3 is constructed from a rigid, cylindrically-shaped, solid rod 19 having a diameter of approximately $\frac{7}{8}$ inches, and a length in the nature of 24 inches. Wedge 4 or other similar mechanism for splitting wood is fixedly attached to the lower end 20 of rod 3 by suitable means such as weld 21.

Figure 2:
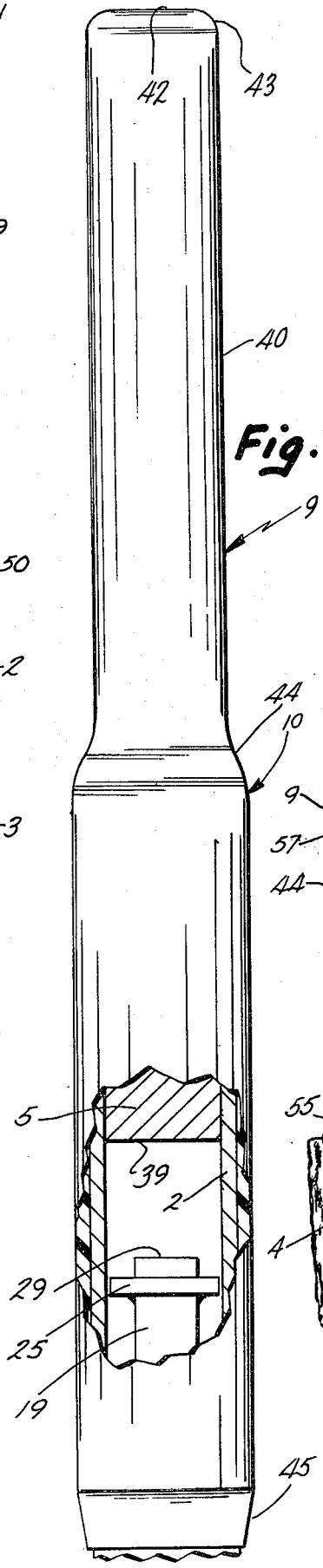
FIG. 2 is a fragmentary, side elevational view of the log splitter in enlarged scale, with a portion thereof broken away to reveal internal construction, shown in a partially extended condition.

The upper end 7 of ram 3 is slidingly mounted within housing 2 by a pair of annularly shaped discs or washers 25 and 26, which are positioned coaxially over the upper end of rod 19, and fixedly attached thereto in a longitudinally spaced apart relationship. Washers 25 and 26 each have a plan shape that is closely and matingly received in the interior of housing 2. Washers 25 and 26 are fixedly attached to rod 19 by means such as welds 27 and 28, respectively, which are disposed on the interior faces of the washers to prevent interfering with the operation of the log splitter, as described in greater detail hereinafter. Preferably, the uppermost washer 25 is attached to rod 19 at a location spaced slightly below the upper terminal surface or impact surface 29 (FIG. 2) of rod 19 so that even after repeated use, the upper washer 25 will not abut weight 5 during operation. In the illustrated example, upper washer 25 is spaced approximately $\frac{1}{4}$ inch below the impact surface 29 of rod 19, and lower washer 26 is spaced approximately 3 inches from upper washer 25. The spacing of washers 25 and 26 on the upper end of rod 19 provide secure lateral support for ram 3 as housing 2 reciprocates with respect to ram 3. An annularly shaped guide 30 is attached to the lower end 31 of housing 2, and includes a central opening disposed coaxially with the longitudinal axis of housing 2, and is sized to slidingly receive the rod portion 19 or ram 3 therethrough. This mounting arrangement not only permits housing 2 to lie reciprocated with respect to ram 3, but also allows ram 3 to rotate about its longitudinal axis relative to housing 2.

Weight 5 has a transverse cross-sectional shape which is substantially uniform along its entire length, geometrically similar to the transverse cross-sectional shape of housing 2, and is sized to be grasped, and to be closely received into the upper end of housing 2 and anchored therein to form handle 9. The illustrated weight 5 comprises a solid, rigid, cylindrically-shaped rod constructed of mild steel, having a diameter of approximately $1\frac{1}{2}$ inches, and a length of approximately 16 inches. The length of weight 5 can be varied to achieve different impact forces. Weight 5 extends outwardly from the upper end of housing 2 a distance sufficient to form a handle which can be grasped securely by two hands, which in this example is approximately 11 inches. A weld 38 extends around shoulder 15 to fixedly interconnect weight 5 in housing 2. The lower, terminal end 39 (FIG. 2) of weight 5 forms an impact surface against which the upper end 29 of ram 3 abuts repeatedly during operation. The upper end 29 of ram 3 will peen over slightly after extended use, but will then work harden to prevent any further appreciable deformation. The spacing of upper washer 25 slightly below the upper end 29 of ram 3 thereby prevents impact forces from being transmitted directly to washer 25.

It is to be understood that log splitter 1 is fully operational even without sleeve 10, and can be readily manipulated in the manner dexcribed more fully hereinbelow. However, it is preferred that log splitter 1 include sleeve 10 to achieve additional comfort, efficiency and safety. Sleeve 10 is resiliently compressible, at least in the radial direction, and envelopes the outwardly protruding portion of weight 5 and the upper end of housing 2 to form a cover over handle 9 which is very comfortable to grasp and has a somewhat tacky, non-slip exterior surface. Preferably, sleeve 10 is constructed of an integrally molded, semipliable vinyl, such as polyvinylchloride, and has a thickness in the range of 0.030 to 0.150 inches to provide thermal insulation and vibratory cushioning. Illustrated sleeve 10 extends down over the upper end of housing 2 a distance in the nature of 9 to 10 inches so that it envelopes that portion of housing 2 in which the impact surface 39 of weight 5 is located to provide sound insulation which dampens impact noise. This is particularly beneficial when the tool is used indoors, such as a barn, garage, or the like. Sleeve 10 has generally bottle shape, with a smaller diameter top half 40 (FIG. 2) and larger diameter bottom half 41 which conform to the outside diameters of weight 5 and housing 2, respectively. The upper end 42 of sleeve 10 has a rounded edge 43 to cover any sharp edges on the upper end of weight 5 and curves at the transition area between the upper and lower halves 40 and 41 to form a shoulder portion 44 of sleeve 10 against which the lower hand of the user may rest. The lower end 45 of sleeve 10 is tapered inwardly toward housing 2 to provide secure mounting and a streamlined appearance. Sleeve 10 may be attached to the upper end of log splitter 1 by any suitable means but is preferably attached by an adhesive or the like which does not interfere with the grasping surface. The adhesive secures sleeve 10 to both weight 5 and housing 2, whereby in the unlikely event that the anchoring means (i.e., weld 38) would fail during an impact stroke the sleeve will resist bodily separation of the weight from the housing, thereby providing improved safety.

A hitch pin 50 (FIG. 1) is provided to retain ram 3 in a fully retracted position within housing 2, as shown in FIG. 1, to facilitate storage and transport. Pin 50 extends through an aperture oriented transversely through housing 2 at a location thereon slightly below the position of the lower washer 26 when ram 3 is fully retracted. The pin aperture extends through the side wall of housing 2 at two points, along a line laterally offset from longitudinal axis of the housing a distance equal to or slightly greater than the radius of rod 19, in the nature of a chord when viewed in top plan view. When pin 50 is inserted to its mating aperture, the pin abuts the lower face of washer 26 to positively retain ram 3 in the fully retracted position. This lock-pin arrangement permits the user to insert pin 50 into its mating aperture and thereby lock the log splitter for storage regardless of the rotational orientation of ram 3.

A very economical and uncomplicated method for making log splitter 1 comprises the following manufacturing steps. Housing 2 is formed by selecting conventional tubing having a girth predetermined in accordance with the above parameters, and cutting the same to a predetermined length. The mating aperture for pin 50 is drilled through housing 2 at a location that will cause pin 50 to be disposed slightly below lower washer 26 when the log splitter is fully retracted and assembled. Weight 5 is formed by selecting a solid rod having a transverse cross-sectional shape which is matingly and closely received within the interior of housing 2, and cutting the same to a predetermined length. The lower end of weight 5 is inserted into the upper end of housing 2, and the weight is positioned so that the upper end of the weight extends outwardly from the upper end of the housing a distance sufficient to form handle 9. The lower end of weight 5 is then anchored in the upper end of housing 2 by means such as weld 38.

Ram 3 is formed by cutting a predetermined length of solid, rigid rod, and then positioning washers 25 and 26 over the upper end thereof in a longitudinally spaced apart fashion, and securely fastening the washers in place by means such as welds 27 and 28. Guide 30 is then slipped or threaded over the lower end of rod 3, and wedge 4 is welded in place. The upper end of ram 3 is then inserted into the lower end of housing 2, and guide 30 is welded to the lower end of housing 2 so as to complete the assembly.

Sleeve 10 may be formed in any suitable manner, including dip-molding on a mandrel, and is assembled onto log splitter 1 by applying adhesive to the upper end of the log splitter and to the leading edge of the sleeve and then slipping the sleeve over the tool. Preferably, corresponding transverse apertures or pockets are formed in sleeve 10 to mate with the aperture for pin 50.

Figure 3:
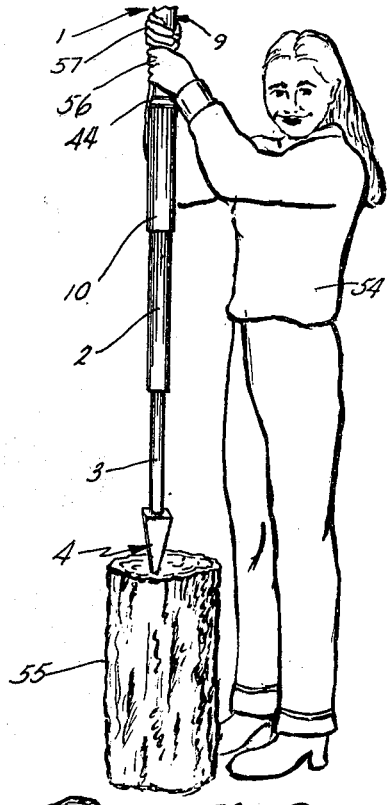
FIG. 3 is a partially schematic, elevational view of the log splitter, being lifted by an operator to a raised position prior to impact.
Figure 4:
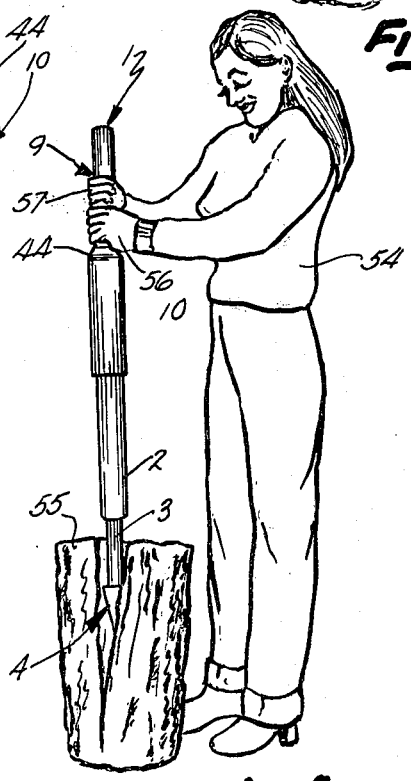
FIG. 4 is a partially schematic, elevational view of the log splitter, shown after the tool has been thrust downwardly into a log by the operator.

In operation, the user 54 bodily lifts log splitter 1 onto a fireplace size log 55 with the tip of wedge 4 abutting the upper surface of the log. The user then removes pin 50, grasps handle 9, lifts housing 2 and weight 5 upwardly to a height which the operator finds comfortable, as shown in FIG. 3. Abutment between lower washer 26 and guide 30 will prevent ram 3 from sliding out of housing 2. With the operator's lower hand 56 resting firmly against the shoulder portion 44 of handle 9, the operator applies downward force or thrust to the housing and weight assembly, thereby causing the lower surface 39 of weight 5 to impact against the upper end 29 of ram 3 and forcing wedge 4 through the log and causing the same to split. A baseball type of grip, as shown in FIGS. 3 and 4, wherein the user's upper hand 57 is located on the handle adjacent to lower hand 56 has proven to be quite effective. If the log does not split immediately, the operator simply repeats the up-and-down stroke for the housing and weight assembly until wedge 4 is driven completely through the log. In the event that wedge 4 hits a knot or other similar obstruction, the operator reverses the direction of impact so that the lower washer 26 abuts guide 30 and thereby applies an upwardly directed force on the wedge 4 to remove it from the log. The resiliently compressible sleeve 10 not only provides a nonslip surface which is easy and comfortable to grip, but also provides thermal insulation, absorbs vibrations created by the impact, and dampens impact noise.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. In a manual, impact-type log splitter, the improvement comprising:

a hollow tubular housing having a transverse cross-sectional shape which is substantially uniform along its entire length;

a ram having an upper end thereof with means for slidingly mounting the same in the interior of said housing for reciprocation therein, and a lower end with means connected therewith for splitting wood;

an elongate weight having a transverse cross-sectional shape which is substantially uniform along its entire length, geometrically similar to the transverse cross-sectional shape of said housing, and sized for grasping and close telescoping reception into the upper end of said housing; said weight having a lower end extending into said housing upper end, and upper end extending outwardly from said housing upper end a predetermined distance of sufficient length to be firmly grasped by two hands;

means for fixedly anchoring the lower end of said weight in the upper end of said housing; and a resiliently compressible sleeve disposed over and enveloping the upper end of said weight and at least a portion of the upper end of said housing, whereby the lower end of said weight forming an impact surface against which the upper end of said ram abuts during operation, and the upper end of said weight forming a handle, covered by said sleeve for secure, comfortable operation of said log splitter.

2. A log splitter as set forth in claim 1, wherein:

said housing has a sufficiently large side wall thickness to form a shoulder at the base of said handle against which a lower one of the grasping hands may rest for more effectively imparting downward impact thrust to said housing, and reducing operator fatigue.

3. A log splitter as set forth in claim 2, wherein:

said sleeve is constructed of integrally molded vinyl having a thickness of at least 0.030 inches to provide thermal insulation and vibrator cushioning.

4. A log splitter as set forth in claim 3, wherein:

said impact surface of said weight is disposed within that portion of said housing enveloped by said sleeve, whereby said sleeve provides sound insulation which dampens impact noise.

5. A log splitter as set forth in claim 4, wherein:

said sleeve is secured adhered to both said weight and said housing, whereby in the event that said anchoring means fails, said sleeve resists bodily separation of said weight from said housing.

6. A log splitter as set forth in claim 5, wherein:

said sleeve is constructed from molded polyvinylchloride.

7. A log splitter as set forth in claim 6, wherein:

said housing has a cylindrical shape; and said weight comprises a solid rod.

8. A log splitter as set forth in claim 7, wherein:

said anchoring means comprises a weld extending about the upper end of said housing.

9. A log splitter as set forth in claim 8, wherein:

said ram includes a cylindrical rod having a diameter which is significantly smaller than the inside diameter of said housing.

10. A log splitter as set forth in claim 9, wherein said ram mounting means comprises:

a pair of washers positioned coaxially over the upper end of said rod, and fixedly attached thereto in a longitudinally spaced apart relationship; said washers having a plan shape for close, sliding reception in the interior of said housing; and an annularly shaped guide attached to the lower end of said housing and having an opening therethrough disposed coaxial with said housing, and sized to slidingly receive said rod therethrough.

11. A log splitter as set forth in claim 10, wherein:

an uppermost one of said washers is attached to said rod at a location thereon spaced slightly below the upper end thereof, whereby even after repeated use, said uppermost washer will not abut said weight.

12. A log splitter as set forth in claim 11, including:

means for retaining said ram in a fully retracted position within said housing for storage and transport.

13. A log splitter as set forth in claim 12, wherein said retaining means comprises:

an aperture extending transversely through said housing at a location thereon slightly below the position of the lowermost one of said washers in the fully retracted ram position; said aperture extending through the side wall of said housing at two points, along a line laterally offset from the longitudinal axis of said housing; and a pin selectively received in said aperture and abutting a lower face of said lowermost washer for positively retaining said ram in the fully retracted position.

14. A log splitter as set forth in claim 1, wherein:

said sleeve is constructed of integrally molded vinyl having a thickness of at least 0.030 inches to provide thermal insulation and vibrator cushioning.

15. A log splitter as set forth in claim 1, wherein:

said impact surface of said weight is disposed within that portion of said housing enveloped by said sleeve, whereby said sleeve provides sound insulation which dampens impact noise.

16. A log splitter as set forth in claim 1, wherein:

said sleeve is secured adhered to both said weight and said housing, whereby in the event that said anchoring means fails, said sleeve resists bodily separation of said weight from said housing.

17. A log splitter as set forth in claim 1, wherein:

said sleeve is constructed from molded polyvinylchloride.

18. A log splitter as set forth in claim 1, wherein:

said housing has a cylindrical shape; and said weight comprises a solid rod.

19. A log splitter as set forth in claim 1, wherein:

said anchoring means comprises a weld extending about the upper end of said housing.

20. A log splitter as set forth in claim 1, wherein:

said ram includes a cylindrical rod having a diameter which is significantly smaller than the inside diameter of said housing.

21. A log splitter as set forth in claim 20, wherein said ram mounting means comprises:

a pair of washers positioned coaxially over the upper end of said rod, and fixedly attached thereto in a longitudinally spaced apart relationship; said washers having a plan shape for close, sliding reception in the interior of said housing; and an annularly shaped guide attached to the lower end of said housing and having an opening therethrough disposed coaxial with said housing, and sized to slidingly receive said rod therethrough.

22. A log splitter as set forth in claim 21, wherein:

an uppermost one of said washers is attached to said rod at a location thereon spaced slightly below the upper end thereof, whereby even after repeated use, said uppermost washer will not abut said weight.

23. A log splitter as set forth in claim 1, including:

means for retaining said ram in a fully retracted position within said housing for storage and transport.

24. In a manual, impact-type log splitter, the improvement comprising:

a hollow housing having upper and lower ends;

a ram having an upper end thereof with means for slidingly mounting said ram in the interior of said housing for reciprocation therein, and a lower end with means connected therewith for splitting wood;

an elongate weight having a lower end with a transverse cross-sectional shape which is geometrically similar to the upper end of said housing, and is closely received therein; said weight having a girth sized for grasping, and an upper end which extends outwardly from said housing upper end a predetermined distance of sufficient length to be firmly grasped by two hands;

means for fixedly anchoring the lower end of said weight in the upper end of said housing; and said lower end of said weight forming an impact surface against which the upper end of said ram abuts during operation, and the upper end of said weight forming a handle.

25. A log splitter as set forth in claim 24, wherein:

said housing has a cylindrical shape; and said weight comprises a solid, cylindrically shaped rod.

26. A log splitter as set forth in claim 25, wherein:

said rod has a diameter of substantially $1\frac{1}{2}$ inches for comfortable grasping.

27. A log splitter as set forth in claim 26, wherein:

said housing has an outside diameter of substantially $1\frac{3}{4}$ inches whereby said shoulder fits comfortably.

28. A log splitter as set forth in claim 27, wherein:

said anchoring means comprises a weld extending about the upper end of said housing.

29. A log splitter as set forth in claim 24, wherein:

said housing has a sufficiently large side wall thickness to form a shoulder at the base of said handle against which a lower one of the grasping hands may rest for more effectively imparting downward impact thrust to said housing, and reducing operator fatigue.

30. A log splitter as set forth in claim 24, including:

a resiliently compressible sleeve disposed over and enveloping the upper end of said weight and at least a portion of the upper end of said housing, whereby the upper end of said weight forms a covered handle for secure, comfortable operation of said log splitter.

31. A log splitter as set forth in claim 24 wherein said ram mounting means comprises:

a pair of washers positioned coaxially over the upper end of said ram, and fixedly attached thereto in a longitudinally spaced apart relationship; said washers having a plan shape for close, sliding reception in the interior of said housing; and an annularly shaped guide attached to the lower end of said housing and having an opening therethrough disposed coaxial with said housing, and sized to slidingly receive said ram therethrough.

32. In a method for making manual, impact-type log splitters, the improvement comprising the steps of:

selecting hollow tubing having a substantially uniform transverse cross-sectional shape, and a predetermined girth;

cutting a predetermined length of said tubing to define a housing with upper and lower ends;

providing a ram having an upper end with means thereon for slidingly mounting said ram in the interior of said housing for reciprocation therein, and a lower end with means connected therewith for splitting wood;

selecting a solid rod having a substantially uniform transverse cross-sectional shape of said housing, and is sized for close reception therein, with a girth adapted for grasping;

cutting a predetermined length of said rod to define a weight with upper and lower ends;

inserting the lower end of said weight into the upper end of said housing, and positioning said weight so that the lower end of said weight forms an impact surface against which the upper end of said ram abuts during operation, and the upper end of said weight extends from the upper end of said housing a distance sufficient to securely grasp the same with two hands; and fixedly anchoring the lower end of said weight in the upper end of said housing, whereby the upper end of said weight forms a handle for secure, comfortable operation of said log splitter.

33. A method as set forth in claim 32, wherein:

said tubing selecting step further comprises selecting tubing having a sufficiently large side wall thickness that when said weight is assembled into said housing, a shoulder is formed at the base of said handle against which a lower one of the grasping hands may rest for more effectively imparting downward impact thrust to said housing and reducing operator fatigue.

34. A method as set forth in claim 33, including:

cutting a preselected length of rod having a substantially uniform transverse cross-sectional shape, with a girth shaped to be received within said housing; and connecting said wood splitting means with a lower end of said rod, thereby forming said ram.

35. A method as set forth in claim 34, including:

providing a pair of washers having a plan shape adapted for close, sliding reception in the interior of said housing, and a central opening shaped for close reception over said rod portion of said ram;

positioning said washers on the upper end of said rod in a longitudinally spaced apart relationship; and fixedly attaching said washers to said rod to form a portion of said sliding mounting means.

36. A method as set forth in claim 35, including:

providing an annularly shaped guide with a central opening shaped to slidingly receive said rod therein;

positioning said guide on said rod; and connecting said guide with the lower end of said housing.

37. A method as set forth in claim 36, including:

forming a resiliently compressible sleeve shaped for positioning over and enveloping the upper end of said weight and at least a portion of the upper end of said housing;

positioning said sleeve over the upper portion of said weight and a corresponding portion of the upper end of said housing; and adhering said sleeve to said log splitter to form a cover for said handle.

38. In a manual, impact-type log splitter, the improvement comprising:

a hollow housing having upper and lower ends;

a ram having an upper end thereof with means for slidingly mounting said ram in the interior of said housing for reciprocation therein, and a lower end with means connected therewith for splitting wood;

an elongate weight having a lower end with a transverse cross-sectional shape which is geometrically similar to the upper end of said housing, and is closely received therein; said weight having a girth sized for grasping, and an upper end which extends outwardly from said housing upper end a predetermined distance of sufficient length to be firmly grasped by two hands; and a resiliently compressible sleeve disposed over and enveloping the upper end of said weight and at least a portion of the upper end of said housing, whereby the upper end of said weight forms a covered handle for secure, comfortable operation of said log splitter.

39. In a method for making manual, impact-type log splitters, the improvement comprising the steps of:

selecting hollow tubing having a substantially uniform transverse cross-sectional shape, and a predetermined girth;

cutting a predetermined length of said tubing to define a housing with upper and lower ends;

providing a ram having an upper end with means thereon for slidingly mounting said ram in the interior of said housing for reciprocation therein, and a lower end with means connected therewith for splitting wood;

selecting a solid rod having a substantially uniform transverse cross-sectional shape of said housing, and is sized for close reception therein, with a girth adapted for grasping;

cutting a predetermined length of said rod to define a weight with upper and lower ends;

inserting the lower end of said weight into the upper end of said housing, and positioning said weight so that the upper end of said weight extends from the upper end of said housing a distance sufficient to securely grasp the same with two hands;

fixedly anchoring the lower end of said weight in the upper end of said housing, whereby the upper end of said weight forms a handle for secure, comfortable operation of said log splitter;

forming a resiliently compressible sleeve shaped for positioning over and enveloping the upper end of said weight and at least a portion of the upper end of said housing;

positioning said sleeve over the upper portion of said weight and a corresponding portion of the upper end of said housing; and adhering said sleeve to said log splitter to form a cover for said handle.

* * * * *